United States Patent [19]

Horita et al.

[11] Patent Number: 5,063,760

[45] Date of Patent: Nov. 12, 1991

[54] DIAL LOCK ASSEMBLY

[75] Inventors: Yoshiyuki Horita; Hiroshi Mizuno, both of Toyama; Kiyoyasu Wake, Kawasaki, all of Japan

[73] Assignee: Yoshida Kogyo K. K., Tokyo, Japan

[21] Appl. No.: 415,730

[22] Filed: Oct. 2, 1989

[30] Foreign Application Priority Data

Oct. 18, 1988 [JP] Japan ..... 63-136260

[51] Int. Cl.[5] ..... E05B 67/38

[52] U.S. Cl. ..... 70/23; 70/68

[58] Field of Search ..... 70/23, 67, 68

[56] References Cited

U.S. PATENT DOCUMENTS

| | | | |
|---|---|---|---|
| 2,741,114 | 4/1956 | Poux | 70/68 |
| 4,015,457 | 4/1977 | Fukuroi | 70/68 |
| 4,213,314 | 7/1980 | Trader | 70/68 |
| 4,244,086 | 1/1981 | Gregg | 70/68 X |
| 4,350,375 | 9/1982 | Bako | 70/68 X |
| 4,578,966 | 4/1986 | Kasai | 70/68 |
| 4,691,540 | 9/1987 | Murase | 70/68 |
| 4,792,026 | 12/1988 | Dimmick et al. | 70/68 X |
| 4,884,419 | 12/1989 | Ling | 70/312 X |
| 4,930,323 | 6/1990 | Terada et al. | 70/68 |
| 4,951,485 | 8/1990 | Wake | 70/68 |

FOREIGN PATENT DOCUMENTS

| | | | |
|---|---|---|---|
| 404782 | 1/1934 | United Kingdom | 70/68 |

*Primary Examiner*—Robert L. Wolfe
*Assistant Examiner*—Suzanne L. Dino
*Attorney, Agent, or Firm*—Hill, Van Santen, Steadman & Simpson

[57] ABSTRACT

A dial lock assembly suitable for use on a slide fastener comprises a male part and a female part interengageable therewith, the male part having a plunger adapted to move into and out of the female part, a lock tumbler pivotably engageable with the plunger and, a rotary means operatively associated with the lock tumbler and frictionally driven by a dial carrying indicia thereon such as numerical figures, the combination of which being selected to lock and unlock the assembly.

10 Claims, 7 Drawing Sheets

DIAL LOCK ASSEMBLY

BACKGROUND OF THE INVENTION

1. Field of the Invention

This invention relates to a locking device and more particularly to a keyless combination or dial lock for use on slide fasteners and other closure articles for security purposes.

2. Prior Art

Many lock devices have been proposed for locking slide fasteners by means of a pair of sliders adapted to open and close the slide fastener from both directions. One such slider lock as disclosed in Japanese Utility Model Laid-Open Publication No. 51-101204 comprises a projecting prong in one slider body and a lock pin in the other slider body, the prong and the pin being releasably engageable by a key. Another prior art lock is disclosed in Japanese Utility Model Laid-Open Publication No. 53-36903, which lock comprises a pair of annular swivels, one on the head portion of each of two companion sliders, the two swivels being juxtaposed and locked together by a locking member such as a padlock.

Since the above prior art slider locks were both unitary with the slider body, it was necessary to change the whole sliders with those of different designs and shapes from a limited selection to meet the customers' needs which would literally add to the cost of relatively expensive sliders with locks. The prior art slider locks were key-operated and hence care would be always required so as not to lose the key.

Some keyless dial locks are also known but are not entirely satisfactory in respect of the efficiency and reliability of locking operation particularly when they are applied to slide fasteners.

SUMMARY OF THE INVENTION

With the foregoing drawbacks of the prior art in view, it is the primary object of the present invention to provide a keyless combination lock assembly for use on slide fasteners and the like which is highly efficient and reliable in operation.

More specifically, the invention is directed to a combination lock assembly formed integrally with a slider pull tab which is separable from the slider body so that sliders alone of various forms and designs can be readily changed in compliance with the customers' specification.

A keyless combination lock assembly according to the invention comprises a pair of slider pull tabs, one of which constitutes a male part of the lock engageable with a female part of the lock in the other mating pull tab with a tight snap fit.

The above and other objects and features of the invention will be more apparent from the following detailed description taken in conjunction with the accompanying drawings. Like reference numerals refer to like or corresponding parts throughout the several views.

DETAILED DESCRIPTION OF THE PREFERRED EMBODIMENTS

Figure 1:
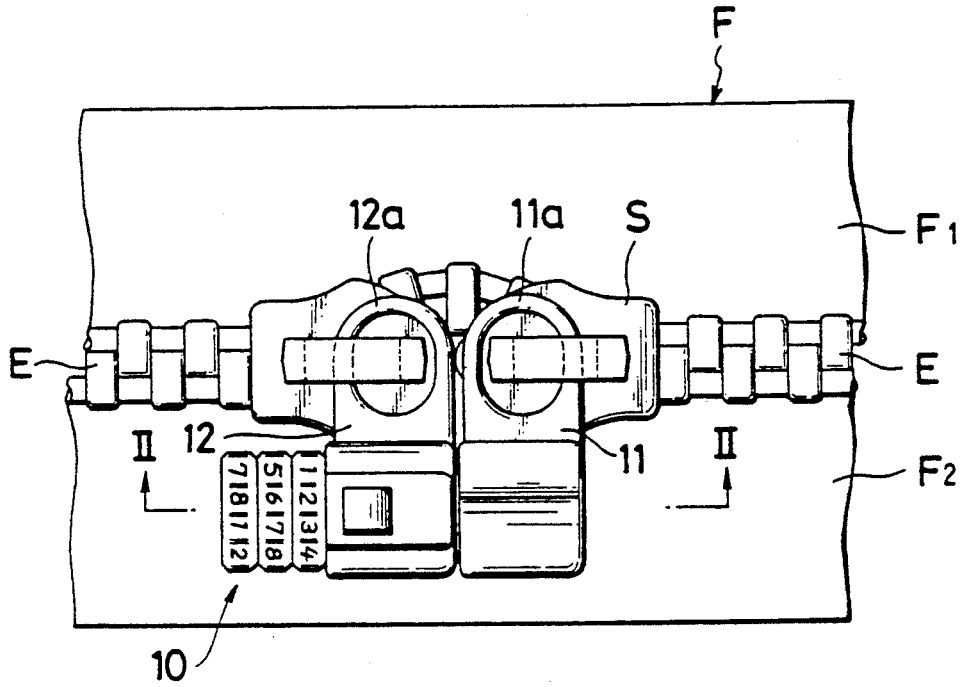
FIG. 1 is a fragmentary plan view of a slide fastener having a pair of lockable sliders embodying the invention.

Referring now to the drawings and FIG. 1 in particular, there is shown a keyless combination or dial lock assembly 10 embodying the invention as applied to a slide fastener F which comprises a pair of stringers $F_1$ and $F_2$ each carrying along one of their longitudinal edges a row of coupling elements E to be coupled and uncoupled by a slider S in a well known manner.

A pair of slider pull tabs 11 and 12 are pivotally connected through their ring-like hooks 11*a*, 12*a* to the slider body S.

The lock assembly 10 comprises a male part 13 integral with one slider pull tab 11 and a female part 14 integral with the other slider pull tab 12, the two parts 13 and 14 being interengageable in a manner hereafter to be described.

The male part 13 of the lock assembly 10 has a plunger 15 formed on one side of the lower portion of the pull tab 11 and extending horizontally inward when the pull tab 11 is positioned in parallel or juxtaposed relation to the mating pull tab 12 as shown in FIG. 1 which represents the locked position of the lock assembly 10. The plunger 15 has a head 16 in the form of a truncated cone defining a beveled guide surface 17. A lock groove 18 is formed in the upper peripheral portion of the plunger 15 for receiving a lock tumbler later described.

Figure 2:
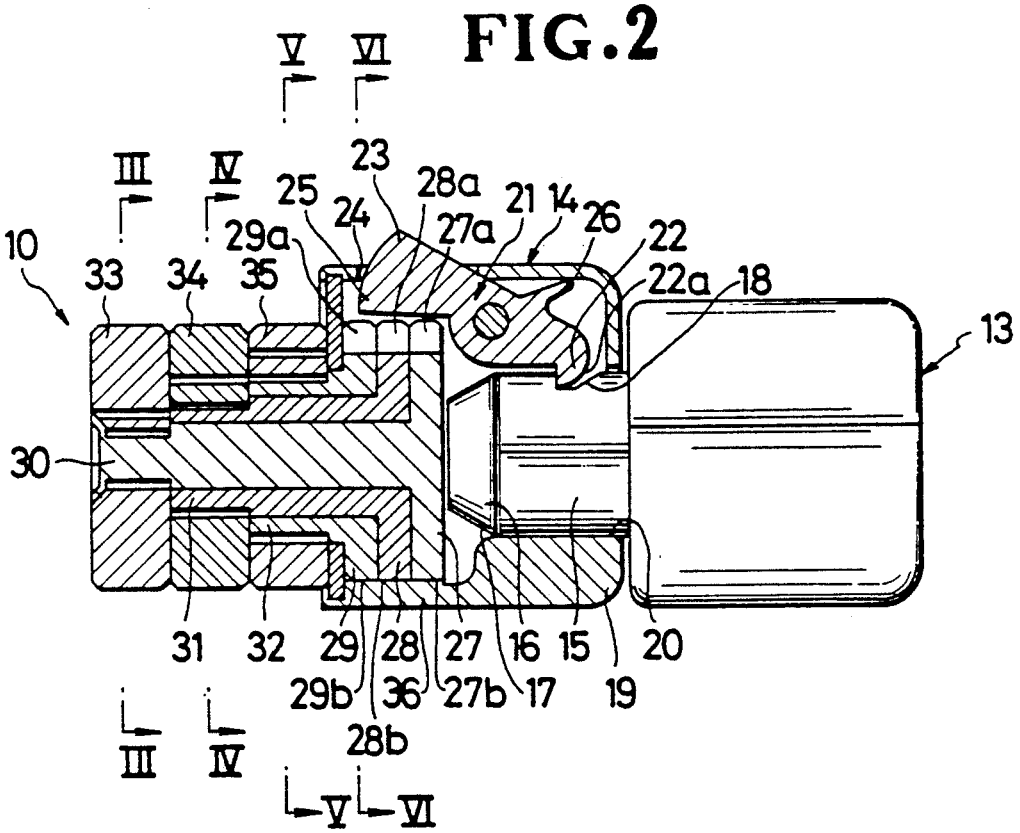
FIG. 2 is a cross-sectional view taken on enlarged scale along the lines II—II of FIG. 1.

The female part 14 of the lock assembly 10, as better shown in FIG. 2, comprises a generally cylindrical casing 19 provided in its inner end wall with an opening 20 defining a passage for the plunger 15 of the male part 13.

Figure 6:
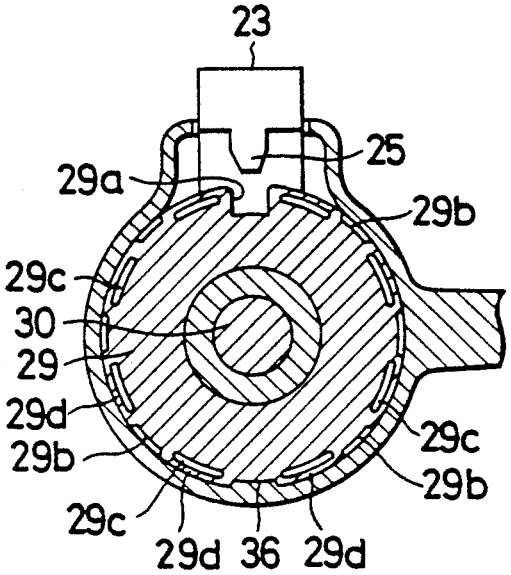
FIG. 6 is a cross-sectional view taken along the lines VI—VI of FIG. 2.

A lock tumbler 21 is pivotally mounted in the casing 19 and provided at one end with a lock prong 22 having an arcuate cam surface 22*a* and engageable in the lock groove 18 in the plunger 15 and at the other end with a press portion 23 projecting above the upper periphery of the casing 19 through an aperture 24 formed therein. The tumbler 21 is further provided with a downwardly projecting rib 25 (FIG. 6) underlying the press portion 23 and with a resilient lug 26 extending upwardly above the prong 22 in abutting relation to the inner wall of the casing 19 and normally biasing the prong 22 toward the lock groove 18. To this end, the tumbler 21 per se may be made of a resilient plastics material so as to form the resilient lug 26 integrally therewith. Alternatively, a leaf spring may be employed for the lug 26.

Coupling of the male and female parts 13 and 14 is effected with the plunger 15 inserted through the opening 20 into the casing 19, when the truncated cone head 16 advances slidingly along the arcuate cam surface 22*a* of the prong 22 against the tension of the lug 26 until the prong 22 is arrested in the lock groove 18. The two cooperating parts 13 and 14 are uncoupled or separated by depressing the press portion 23 to release the prong 22 from the lock groove 18 and thereafter pulling the plunger 15 out of the casing 19.

Means is provided according to the invention for respectively prohibiting and allowing the pivotal movement of the lock tumbler 21 to keep locked and unlock the lock assembly 10. This means comprises a plurality of discs 27, 28 and 29 which are capable of inching rotation (by means hereafter to be described) relatively to one another within the casing 19 and which have radial notches 27*a*, 28*a* and 29*a*, respectively according to the embodiment illustrated in FIGS. 1 through 7. These notches are arranged to register in alignment with one another to form an elongated contiguous U-groove into which the projecting rib 25 enters when the press portion 23 is depressed so as to lift the lock prong 22 of the tumbler 21 apart from the lock groove 18 of the plunger 15.

The discs 27, 28 and 29 are formed integrally with rotary shafts 30, 31 and 32 respectively at one end thereof. The rotary shafts 30, 31 and 32 are reduced in length progressively in this order and each extend horizontally outwardly of the casing 19 in a direction opposite to the opening 20 for the plunger 15. The shafts 30, 31 and 32 are concentrically mounted in superposed relation to one another, the intermediate shaft 31 being rotatably mounted on the inner long shaft 30 and the outer short shaft 32 rotatably mounted on the intermediate shaft 31. The shafts 30, 31 and 32 disposed outside of the casing 19 are attached to and frictionally driven by dials 33, 34 and 35, respectively, in a manner hereafter to be described.

The casing 19 is provided internally with a radially projecting longitudinal rib 36 at least at one location, the rib 36 having a length sufficient to span over the juxtaposed discs 27, 28 and 29 combined as shown in FIG. 2. The discs 27, 28 and 29 each are provided peripherally with a plurality of equally spaced grooves 27*b*, 28*b* and 29*b*, respectively, which are engageable with the rib 36 selectively by operation of either of the dials 33, 34 and 35. To ensure smooth resilient engagement of the rib 36 with the grooves 27*b*–29*b*, there are provided axial slits 27*c*–29*c* each interposed between and slightly above adjacent grooves 27*b*–29*b* as exemplarily shown with respect to the disc 29 in FIG. 6, in which only the slits 29*c* are revealed to allow the solid peripheral surface portions 29*d* overlying the respective slits to elastically deform upon pressure engagement with the rib 36.

Figure 3:
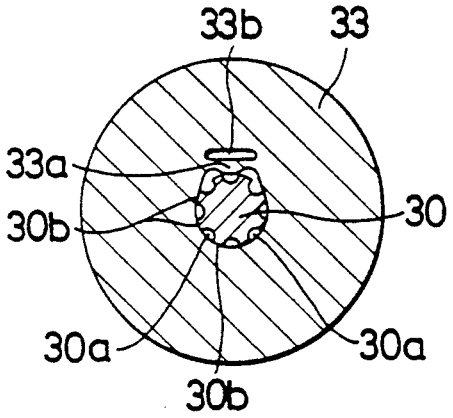
FIG. 3 is a cross-sectional view taken along the lines III—III of FIG. 2.
Figure 4:
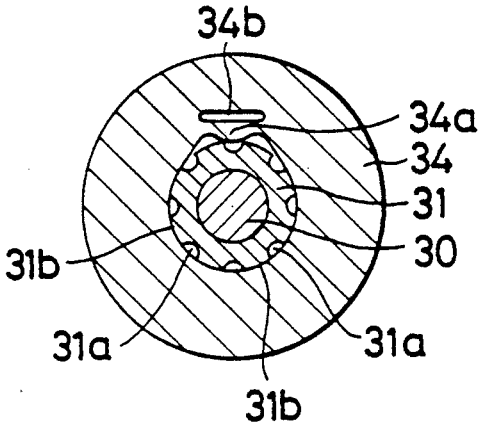
FIG. 4 is a cross-sectional view taken along the lines IV—IV of FIG. 2.
Figure 5:
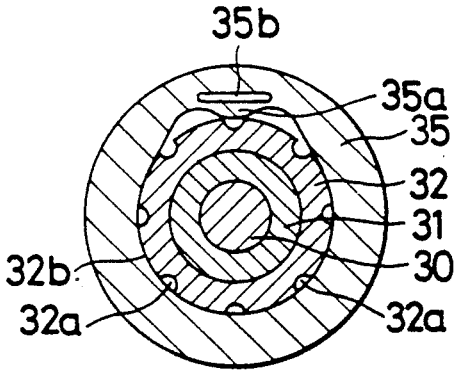
FIG. 5 is a cross-sectional view taken along the lines V—V of FIG. 2.

A similar frictional drive means is embodied in the rotation of shafts 30, 31 and 32 as illustrated in FIGS. 3, 4 and 5, respectively. The shafts 30, 31 and 32 each are provided peripherally with a plurality of equally spaced grooves 30*a*–32*a* which are selectively engageable with radial ribs 33*a*, 34*a* and 35*a* formed on the inner peripheral walls of the dials 33, 34 and 35, respectively. To effect resilient engagement of the ribs 33*a*, 34*a* and 35*a* with the grooves 30*a*, 31*a* and 32*a*, respectively, there are provided axial slits 33*b*, 34*b* and 35*b* underlying the ribs 33*a*, 34*a* and 35*a*, respectively, which slits allow their respective associated ribs to elastically deform or flex inward upon moving contact with the solid peripheral surface portions 30*b*–32*b* between adjacent grooves 30*a*–32*a* of the respective shafts 30–32.

Each of the dials 33, 34 and 35 is provided at its outer periphery with indicia such as numerals which correspond in number to the grooves 30*a* (31*a*, 32*a*). There are a total of eight such grooves in each of the shafts 30, 31 and 32 and hence there are eight digits on each of the dials 33, 34 and 35 which are equally spaced apart in registry with the positions of the grooves 30*a*–32*a* in the respective shafts 30–32.

With the foregoing construction, the lock assembly 10 is locked and unlocked as follows. The pair of slider pull tabs 11 and 12 are oriented to confront side by side, when the plunger 15 is inserted into the casing 19 with the prong 22 arrested in the lock groove 18 as shown in FIG. 2. In this instance, the male and female parts 13 and 14 remain locked if at least one of the notches 27*a*, 28*a* and 29*a* of the respective discs 27, 28 and 29 is displaced or held out of alignment with the rib 25 of the tumbler 21 by rotating the corresponding one of the dials 33, 34 and 35. The lock assembly 10 is unlocked by making inching rotation of all or any of the dials 33, 34 and 35 so as to bring all of the disc notches 27*a*, 28*a* and 29*a* into alignment or registry with the tumbler rib 25, whereupon the press portion 23 is depressed against the tension of the lug 26 to permit entry of the rib 25 into the aligned notches 27*a*, 28*a* and 29*a* and departure of the prong 22 from the lock groove 18 of the plunger 15 which is then ready to be pulled out from the casing 19.

When changing the combination of the numerals on the respective dials 33, 34 and 35, this can be done by retaining the tumbler rib 25 in aligned disc notches 27*a*, 28*a* and 29*a* and making inching rotation of all or any selected one of the dials 33, 34 and 35.

Figure 7:
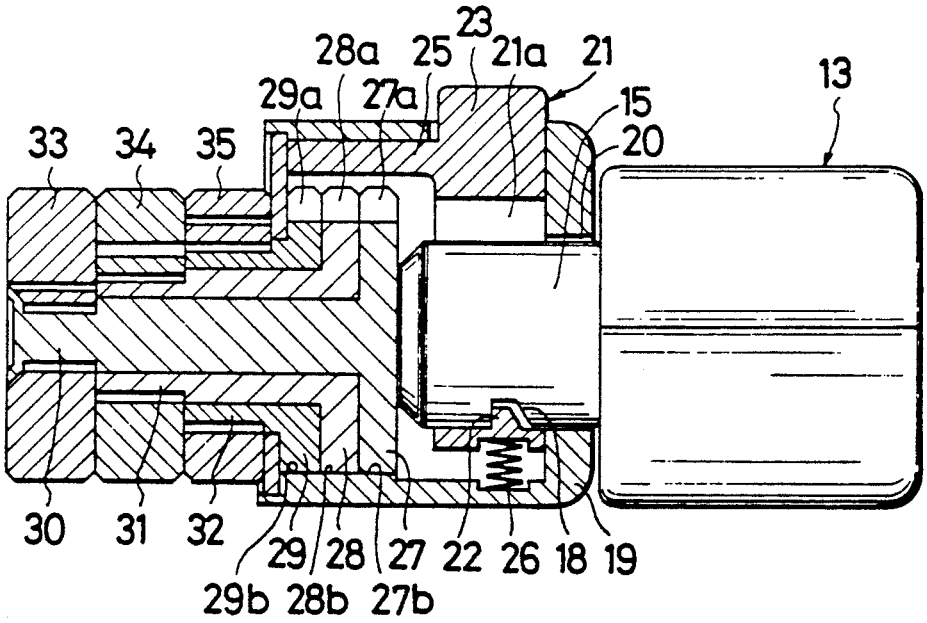
FIG. 7 is a view similar to FIG. 2 but showing a modified form of slider lock according to the invention.
Figure 8:
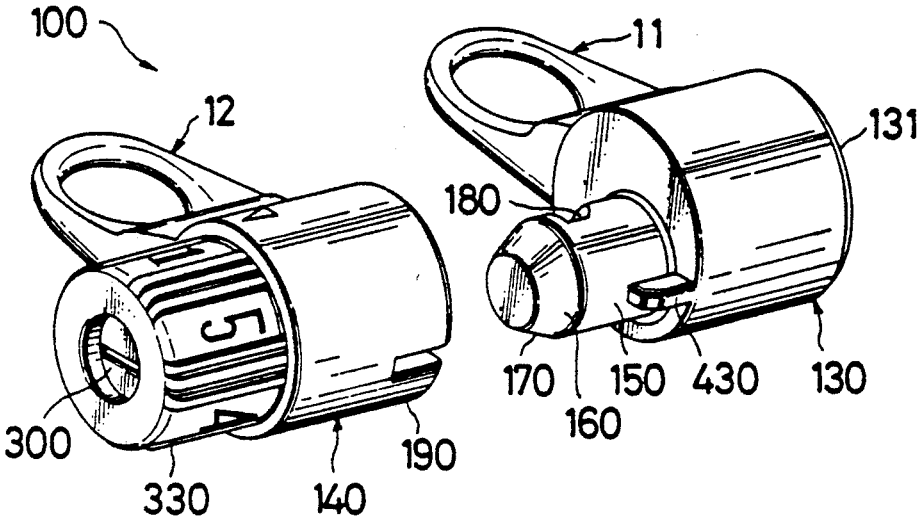
FIG. 8 is an exploded perspective view of another modified form of slider lock.

A lock assembly 10 shown in FIG. 7 is similar in all structural details to the lock assembly 10 already described with reference to FIGS. 1–6, except for the construction of a tumbler 21. This tumbler 21 has an annular chamber 21*a* communicating with the opening 20 for receiving the plunger 15. A prong 22 extends upwardly from the lower portion of the tumbler 21 and is adapted to engage in the lock groove 18. A spring 26 is interposed between the lower inner surface of the casing 19 and the prong 22 and normally biases the tumbler 21 upwardly so that the press portion 23 is exposed above the casing 19 and the rib 25 is lifted apart from the notches 27*a*, 28*a* and 29*a*.

Referring now to FIGS. 8–12 inclusive, there is shown another modified form of lock assembly 100 which comprises a male part 130 having a drum-like body 131 and a female part 140 substantially in the form of a cylindrical casing 190. The male part 130 has a plunger 150 extending horizontally inward from one side of the drum-like body 131. The plunger 150 has a head 160 substantially in the form of a truncated cone defining a beveled guide surface 170.

A lock groove 180 is formed in the upper peripheral portion of the plunger 150 for receiving a lock tumbler 210.

Figure 9:
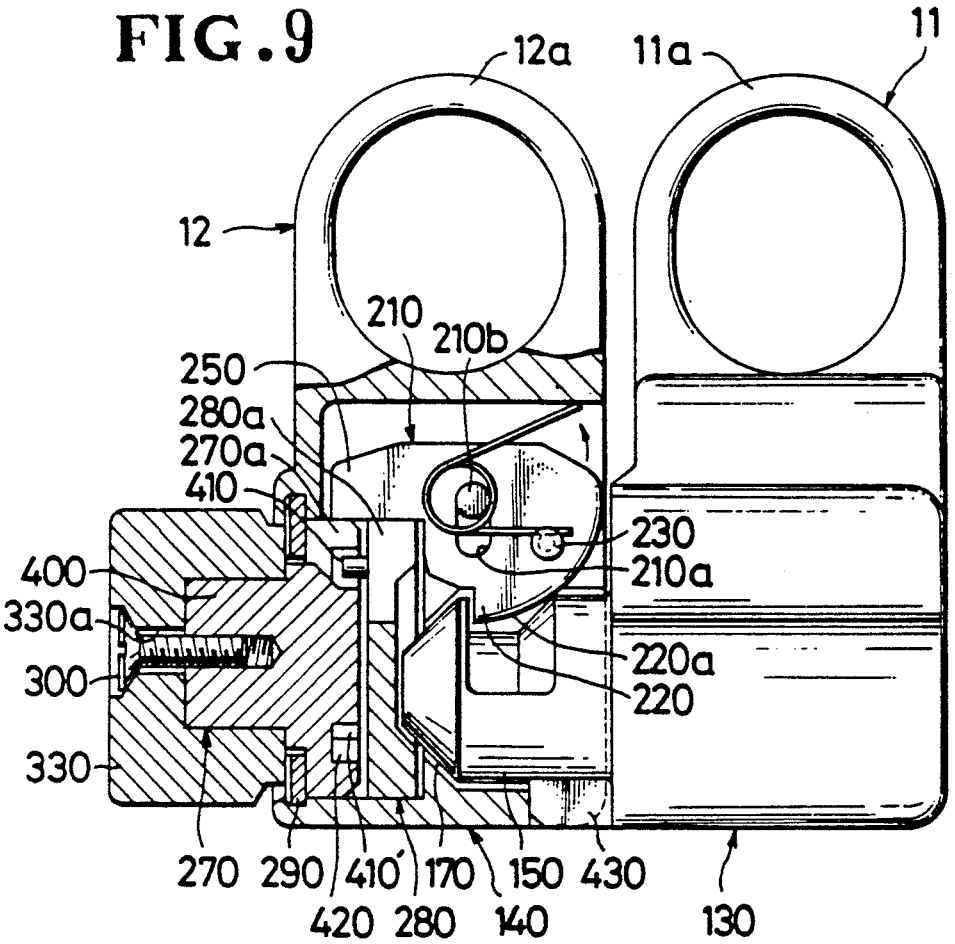
FIG. 9 is a plan view, partly sectional, of the slider lock of FIG. 8.
Figure 10:
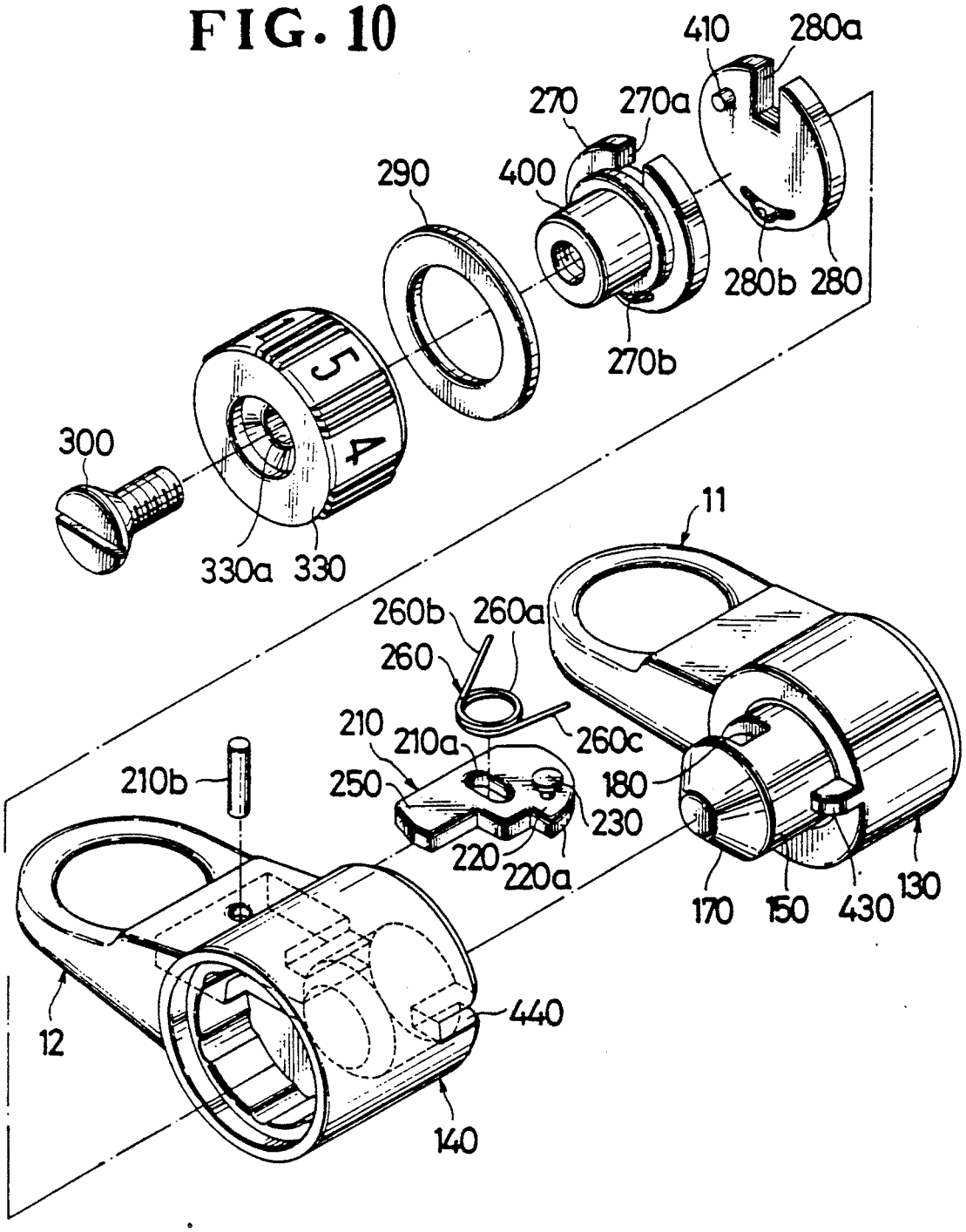
FIG. 10 is an exploded perspective view of the lock assembly shown in FIGS. 8 and 9.
Figure 11:
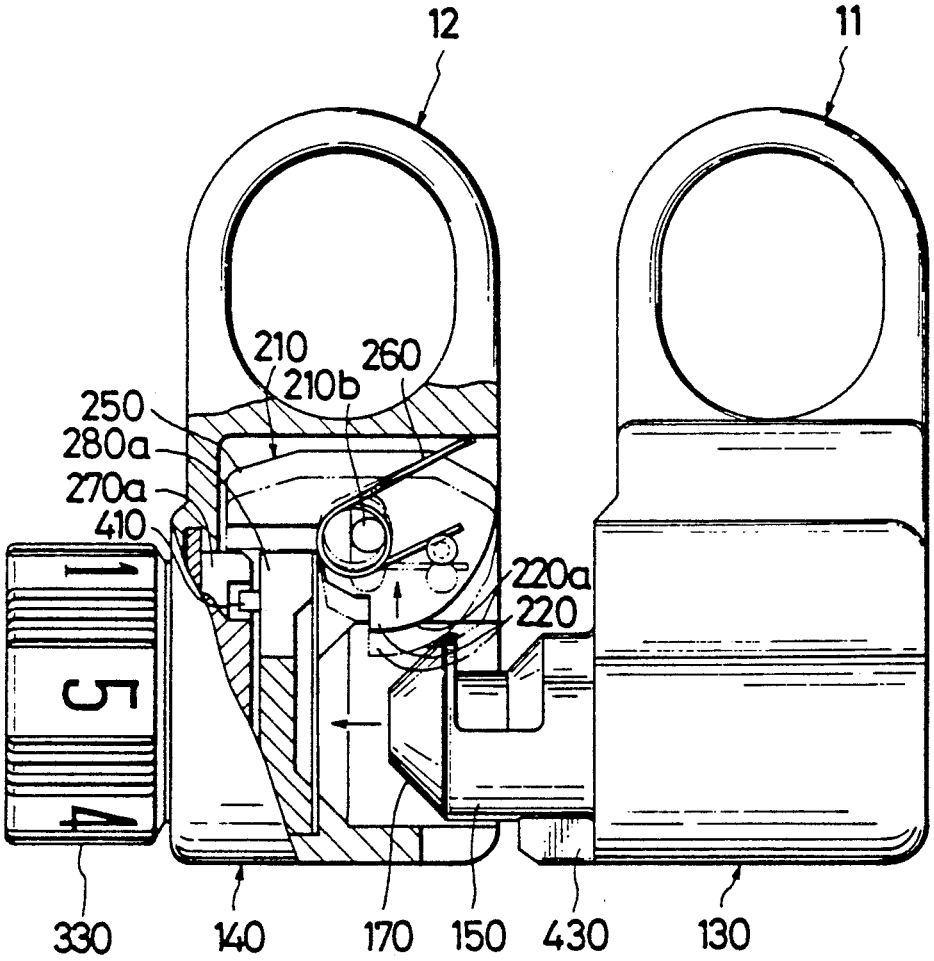
FIG. 11 is a plan view, partly sectional, of the slider lock of FIG. 9, showing the same in one operative position.

The female part 140, as better shown in FIG. 9, comprises a drive disc 270 and a driven disc 280 both rotatably supported within the casing 190. The drive disc 270 has an integral hub 400 concentric therewith which extends outwardly of the casing 190 and which is internally threaded for threaded engagement with a bolt 300 extending from a dial knob 330 through an axial bore 330*a* formed therein. The driven disc 280 has a horizontally projecting eccentric pin 410 movable in an annular groove 420 formed in the rear surface of the drive disc 270 and engageable with a drive pin 410' projecting from the drive disc 270 into the annular groove 420. The driven disc 280 is thus connected to and driven by the drive disc 270.

Designated at 290 is a retaining washer interposed between the drive disc 270 and the dial knob 330 and adapted to hermetically seal the junction therebetween.

The discs 270 and 280 have radial notches 270*a* and 280*a* respectively, which are brought into and out of alignment with each other by rotating the dial 330.

The discs 270 and 280 have axial slits 270*b* and 280*b*, respectively, formed in their lower portions diametrically opposed to the notches 270*a* and 280*a*, the slits 270*b* and 280*b* serving to enable the discs 270 and 280 to be assembled with the casing 190 with a resilient tight fit.

The lock tumbler 210 is pivotally mounted in the casing 190 through an elongated slot 210*a* in which is received a pivotal pin 210*b* extending perpendicular to the plane of the female part 140. The slot 210*a* is vertically elongated so as to allow the tumbler 210 to move substantially linearly vertically in addition to pivotal movement. The tumbler 210 generally in the form of a latch plate has a lock prong 220 including an arcuate cam surface 220*a* and engageable in the lock groove 180, a tongue 250 at an end remote from the prong 220 and an upwardly projecting lug 230 adjacently above the prong 220.

A wire spring 260 has a coil portion 260*a* overlying the elongate slot 210*a* and a first arm portion 260*b* elastically borne against the upper inner wall of the female part 140 and a second arm portion 260*c* elastically supported on the lug 230 of the tumbler 210, the arrangement being that the lock prong 220 of the tumbler 210 is normally biased clockwise to retain locked relation with the plunger 150.

Designated at 430 is a retaining rib axially extending from the lower portion of the male part 13 diametrically opposed to the lock groove 180 of the plunger 150 and adapted to engage in a packet 440 formed in the lower portion of the female part 140 to retain the male part 130 in place when coupled with the female part 140.

Figure 12:
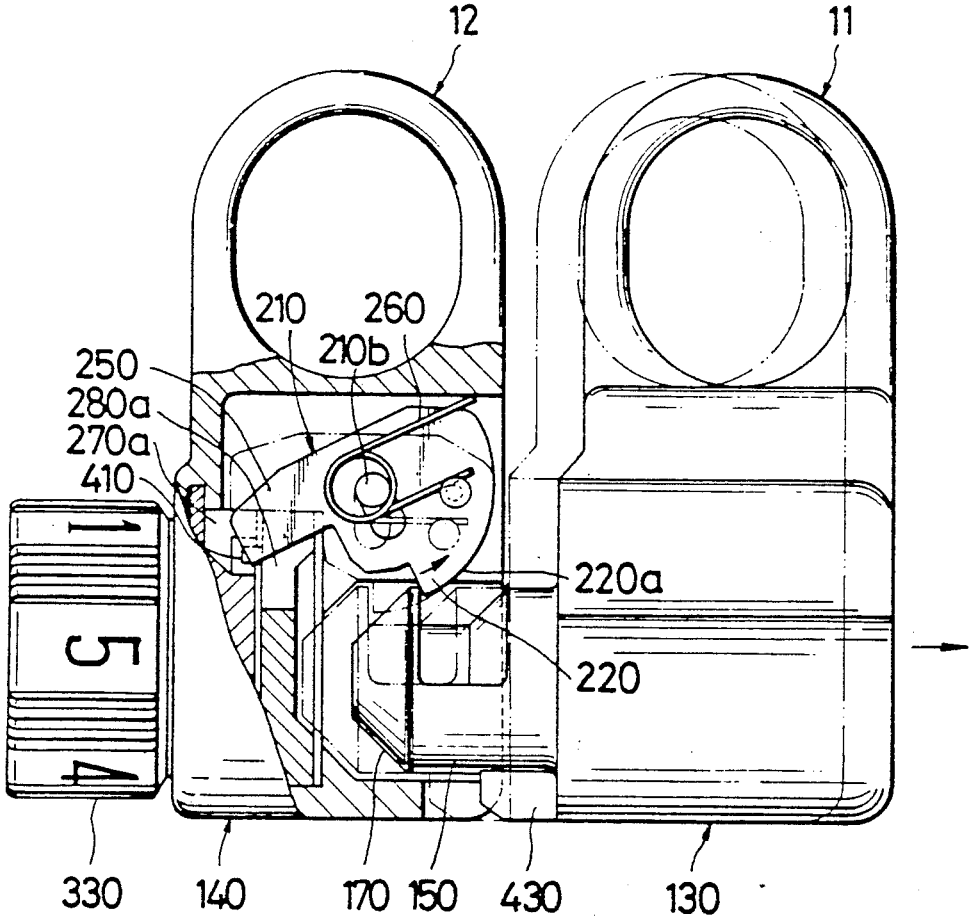
FIG. 12 is a view similar to FIG. 11 but showing the slider lock in another operative position.

With this construction, the lock assembly 100 can be locked and unlocked with ease. Assuming that the radial notches 270*a* and 280*a* of the respective discs 270 and 280 are not aligned to prohibit entry of the tongue 250, the plunger 150 can be inserted into the casing 190, in which instance with advancement of the plunger 150 its beveled guide surface 170 is brought into sliding contact with the cam surface 220*a* of the tumbler 210, causing the latter to move substantially linearly upward against the tension of the spring 260. As the plunger 150 is fully inserted, the tumbler 210 returns to its original position under tension of the spring 260 with the lock prong 220 fully received in the lock groove 180, thereby completing a true lock of the assembly 100. In this instance, if the notches 270*a* and 280*a* are held in confronting relation to the tumbler tongue 250 as shown in FIG. 12, the lock is provisional. To obtain a true lock, the dial know 330 may be simply turned in either direction.

When unlocking the assembly 100 or separating the male part 130 from the female part 140, the dial 330 is turned to match a selected combination of numerals thereon so as to bring the disc notches 270*a* and 280*a* into registry to allow entry therein of the tumbler tongue 250 as shown in FIG. 9. The plunger 150 is then pulled out, when the tumbler 210 rotates about the pin 210 counterclockwise until the lock prong 220 is lifted apart from the lock groove 180.

Various changes and modifications may be made in the above described specific embodiments of the invention without departing from the scope of the appended claims. As for an example, the drive disc 270 and the driven disc 280 may be made unitary to simplify the construction and operation of the lock assembly 100.

What is claimed is:

1. A dial lock assembly which comprises a male part having a plunger with a lock groove and a female part having a cylindrical casing for releasably receiving said plunger, a lock tumbler pivotally mounted in said casing and having a lock prong engageable in said lock groove and an engaging portion, and rotary means operatively associated with said lock tumbler and frictionally driven by a dial carrying indicia thereon and comprising a plurality of discs capable of inching rotation relatively to one another within said casing and mounted on a shaft extending outwardly of said casing and rotatably connected to said dial so as to provide a receptive space for said plunger adjacent to said dics, said means having notches arranged to come into and out of alignment with one another for respectively allowing and prohibiting entry of said engaging portion.

2. A dial lock assembly which comprises a male part having a plunger with a lock groove and a female part having a cylindrical casing for releasbly receiving said plunger, a lock tumbler pivotally mounted in said casing and having a lock prong engageable in said lock groove and an engaging portion, and rotary means operatively associated with said lock tumbler and frictionally driven by a plurality of dials carrying indicia thereon, said means having notches arranged to come into and out of alignment with one another for respectively allowing and prohibiting entry of said engaging portion.

3. A dial lock assembly according to claim 2 wherein said male part and said female part are formed integrally with slider pull tabs.

4. A dial lock assembly according to claim 2 further comprising resilient means normally biasing said lock prong toward said lock groove.

5. A dial lock assembly according to claim 2 wherein said rotary means comprises a plurality of discs capable of inching rotation relatively to one another within said casing and mounted on respective shafts extending outwardly of said casing and rotatably connected to respective dials.

6. A dial lock assembly according to claim 5 wherein said discs have a plurality of peripheral grooves alternating with axial slits and said casing has a radially projecting rib resiliently engageable selectively with said grooves.

7. A dial lock assembly according to claim 2 wherein said shafts have a plurality of equally spaced peripheral grooves and said dials have radial ribs projecting above axial slits and resiliently engageable selectively with said grooves.

8. A dial lock assembly according to claim 2 wherein said rotary means comprises a drive disc connected at one end in threaded engagement with said dial and a driven disc rotatably connected to the other end of said drive disc.

9. A dial lock assembly according to claim 2 wherein said tumbler has a vertically elongated slot engaged with a pivotal pin to permit linear vertical movement of said tumbler along said pin.

10. A dial lock assembly according to claim 2 further comprising a retaining washer interposed between said dial and said drive disc to hermetically seal the junction therebetween.

* * * * *